United States Patent [19]

Bulso, Jr. et al.

[11] Patent Number: 4,503,702

[45] Date of Patent: Mar. 12, 1985

[54] TAPERED CONTAINER AND METHOD AND APPARATUS FOR FORMING SAME

[75] Inventors: Joseph D. Bulso, Jr., Canton; Stephen D. Doyle, North Canton, both of Ohio

[73] Assignee: Redicon Corporation, Canton, Ohio

[21] Appl. No.: 491,756

[22] Filed: May 5, 1983

[51] Int. Cl.[3] ..... B21D 22/00

[52] U.S. Cl. ..... 72/349; 72/348

[58] Field of Search ..... 72/348, 347, 349, 58, 72/406

[56] References Cited

U.S. PATENT DOCUMENTS

| | | | |
|---|---|---|---|
| 1,183 | 5/1861 | Seymour | 72/349 |
| 51,883 | 1/1866 | Wells | 72/349 |
| 3,611,552 | 10/1971 | Cushing et al. | 72/348 |
| 3,695,084 | 10/1972 | Siemonsen et al. | 72/348 |
| 3,786,667 | 1/1974 | Garnett, Jr. | 72/348 |
| 3,793,871 | 2/1974 | Kinghorn | 72/349 |
| 3,811,393 | 5/1974 | Close | 72/348 |
| 3,814,040 | 6/1974 | Habash . | |
| 4,051,707 | 10/1977 | Valek et al. | 72/348 |
| 4,102,467 | 7/1978 | Woodley | 220/67 |
| 4,184,444 | 1/1980 | Woodley . | |
| 4,263,800 | 4/1981 | Arfert et al. | 72/349 |
| 4,366,696 | 1/1983 | Durgin et al. | 72/339 |

*Primary Examiner*—Daniel C. Crane
*Assistant Examiner*—David B. Jones
*Attorney, Agent, or Firm*—Reese Taylor

[57] ABSTRACT

A method and apparatus for forming nestable two-piece containers includes forming a cup from a metal blank; redrawing the cup thus formed to approximately one-half its final height while imparting a tapered sidewall thereto by use of a tapered die center; redrawing the container thus formed to its full height while continuing the taper by use of a second tapered die center while simultaneously profiling the bottom of the container thus drawn. The apparatus includes at least two redraw stations, each including a tapered redraw die center and corresponding die. The second of said stations also includes bottom profiling tooling.

12 Claims, 9 Drawing Figures

TAPERED CONTAINER AND METHOD AND APPARATUS FOR FORMING SAME

FIELD OF THE INVENTION

This invention relates, in general, to tapered metal containers for food or beverages and relates, in particular, to tapered metal containers capable of nesting or stacking for transportation and to a method and apparatus for forming such containers while maintaining uniform sidewall thickness throughout the height of the container.

DESCRIPTION OF THE PRIOR ART

In many industries metal containers or cans are actually made or formed at one location and then shipped to another location where they are filled with the product, such as food, beverages, etc.

In the past, when most cans were made in what is commonly called the "three-piece" method with a welded seam, the cans and their tops and bottoms were all formed at one location, following which the can body itself was flattened out and shipped flat. Then, at the site of filling the can, the can was reformed into its final cylindrical configuration. That system required that, effectively, the can body had to be formed twice. However, since the can components, for shipping purposes at least, were essentially flat, considerable numbers of containers could be shipped in any given cubic space.

More recently, the soldered or welded seam of three-piece cans has come to be considered less desirable because of the fact that the seam has to be coated with special material. In addition to the obvious expense of special coatings, coating adhesion problems also often arise.

The industry has accordingly evolved into frequent use of "two-piece" cans, of which one piece constitutes the cylindrical can body and its bottom wall and the second piece comprises the top. As already mentioned, however, in many instances the cans are still actually manufactured at one location and filled at another, thus presenting serious shipping problems because such a can cannot be flattened for shipping purposes after it has been drawn and redrawn to its final cylindrical configuration.

The difficulty is that each container occupies a given cubic space. Therefore, the volume of large quantities is substantial, making shipping costs excessive. As a practical matter, essentially one is shipping air surrounded by can bodies and the volume is multiplied by the number of containers since they cannot be stacked or nested within each other.

The general solution to this problem is to form a container which is tapered from top to bottom so that the containers will "nest", one with the other. An example of this approach can be seen in Durgin U.S. Pat. No. 4,366,696. Use of such a container permits a significant reduction in shipping space for any given number of cans or containers. There are, however, still problems since it is important that the containers do not stick together and also it is difficult to draw a tapered wall while avoiding wrinkles and maintaining uniform wall thickness. Thus, while tapered containers capable of nesting or stacking have been constructed of molded plastic, as can be seen in Woodley U.S. Pat. Nos. 4,102,467 and 4,184,444, and tapered containers have been produced by impact extrusion, as can be seen in Habash U.S. Pat. No. 3,814,040, the wrinkling problems encountered with drawing metal have heretobefore been unresolved.

The Durgin Patent referred to above represents one solution to the forming problem in that wrinkling is permitted in the first stage operation and then eliminated by diametrically expanding the container in a second stage.

The present invention differs from these teachings by avoiding the wrinkling problem and maintaining uniform sidewall thickness throughout.

SUMMARY OF THE INVENTION

Accordingly, it has now been discovered that with the unique method and apparatus of the present invention, tapered metal cans can be formed with uniform sidewall thickness and without wrinkling in a draw-redraw operation. These cans are formed having a radially extending shoulder or top rim portion extending part of the distance down the depth of the can with a straight sidewall, and thus turning inwardly to form a shoulder or anvil and then continuing in a tapered condition toward the bottom of the can. The relative dimensions between the tapered side, the flat top rim portion and the degree of taper are such that the problem with some nested containers of sticking together is avoided.

It has been found that production of such a tapered container can be achieved by drawing it in two steps (after it has first been blanked and cupped from flat metal stock as is conventional) using suitably tapered die centers.

Thus, the container is first drawn to about one-half of its final height and the shoulder referred to above is formed. The angle of taper may vary but 3° is thought to be the most desirable to avoid wrinkling while permitting effective stacking of the finished product. This draw is accomplished by use of a tapered die center.

Due to the peculiarities of the taper, it has been found that the entire depth cannot be drawn in one operation and it is necessary to then move the container to another station where the remainder of the height is drawn. Since the clearance between the die and the die center changes up the tapered die center, this second operation is necessary to avoid wrinkling.

Accordingly, production of an improved tapered container and the method and apparatus for its manufacture becomes the principal object of this invention with other objects thereof becoming more apparent upon consideration of the following specification considered and interpreted in view of the accompanying drawings.

OF THE DRAWINGS

BRIEF DESCRIPTION OF THE PREFERRED EMBODIMENTS

Before describing the method and apparatus of this invention, the progressive condition of the container, which is the end result, will be described.

Referring first then to FIGS. 1 through 5, it will be seen that the cup is first formed from a flat sheet of tin plate or similar stock as in conventional draw-redraw container forming. That sheet is passed from a sheet feeder of the type shown in Bulso et al U.S. Pat. No. 3,980,297 into the press in the flat condition illustrated in FIG. 1 of the drawings by the letter A.

Figure 1:
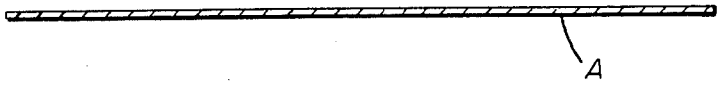
FIG. 1 is a sectional view of the flat stock from which the container is formed.
Figure 2:
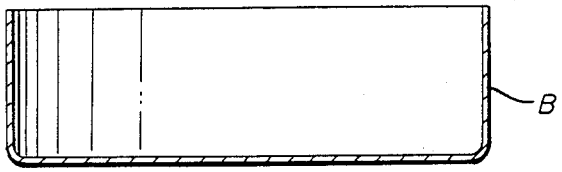
FIG. 2 is a sectional view showing the container after it has been blanked and drawn into a cup.
Figure 6:
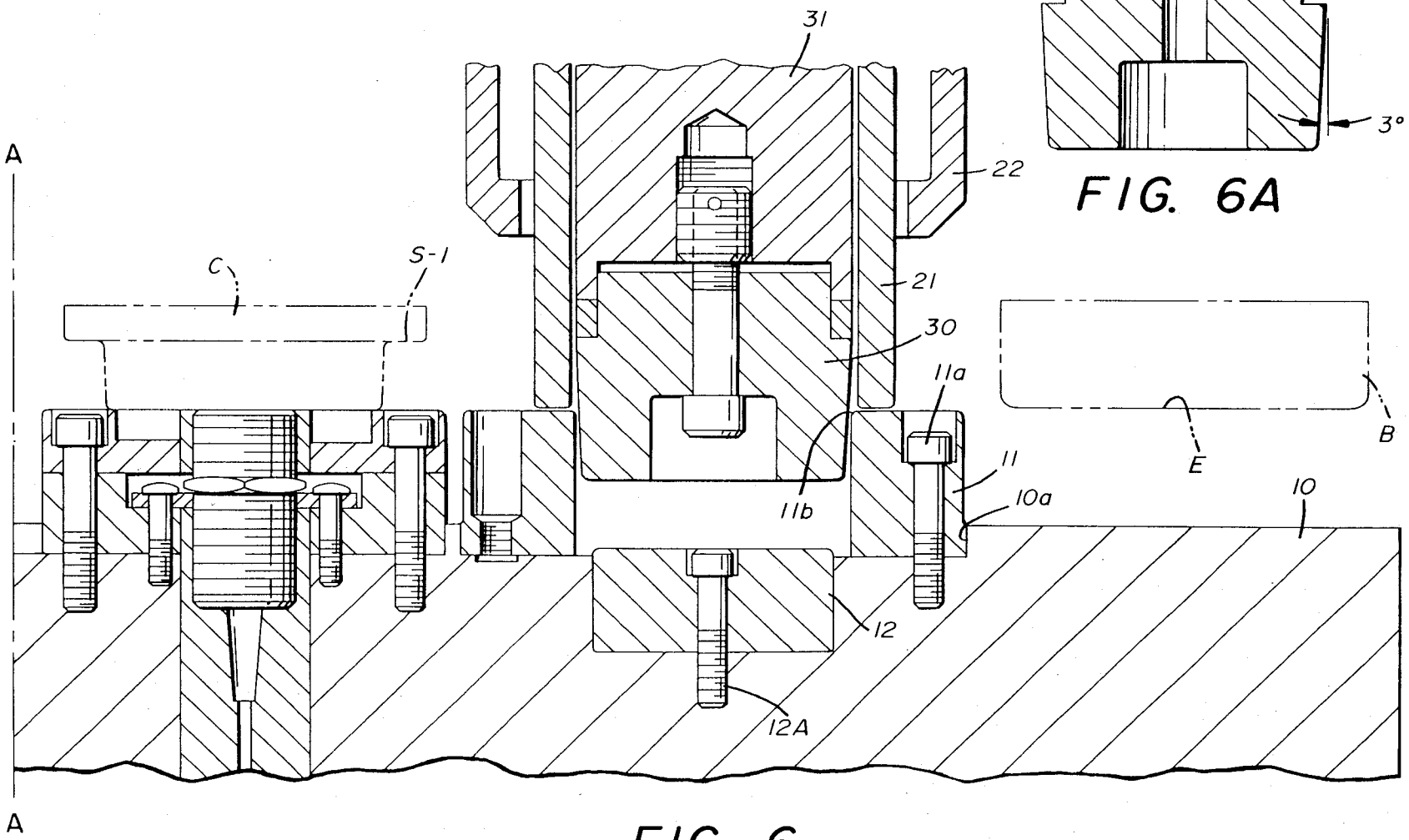
FIGS. 6 and 7 are partially schematic views showing the tooling, and the various positions of the tooling, throughout the successive steps of operation necessary to form the container from the configuration of FIG. 1 to the configuration of FIG. 5.
Figure 7:
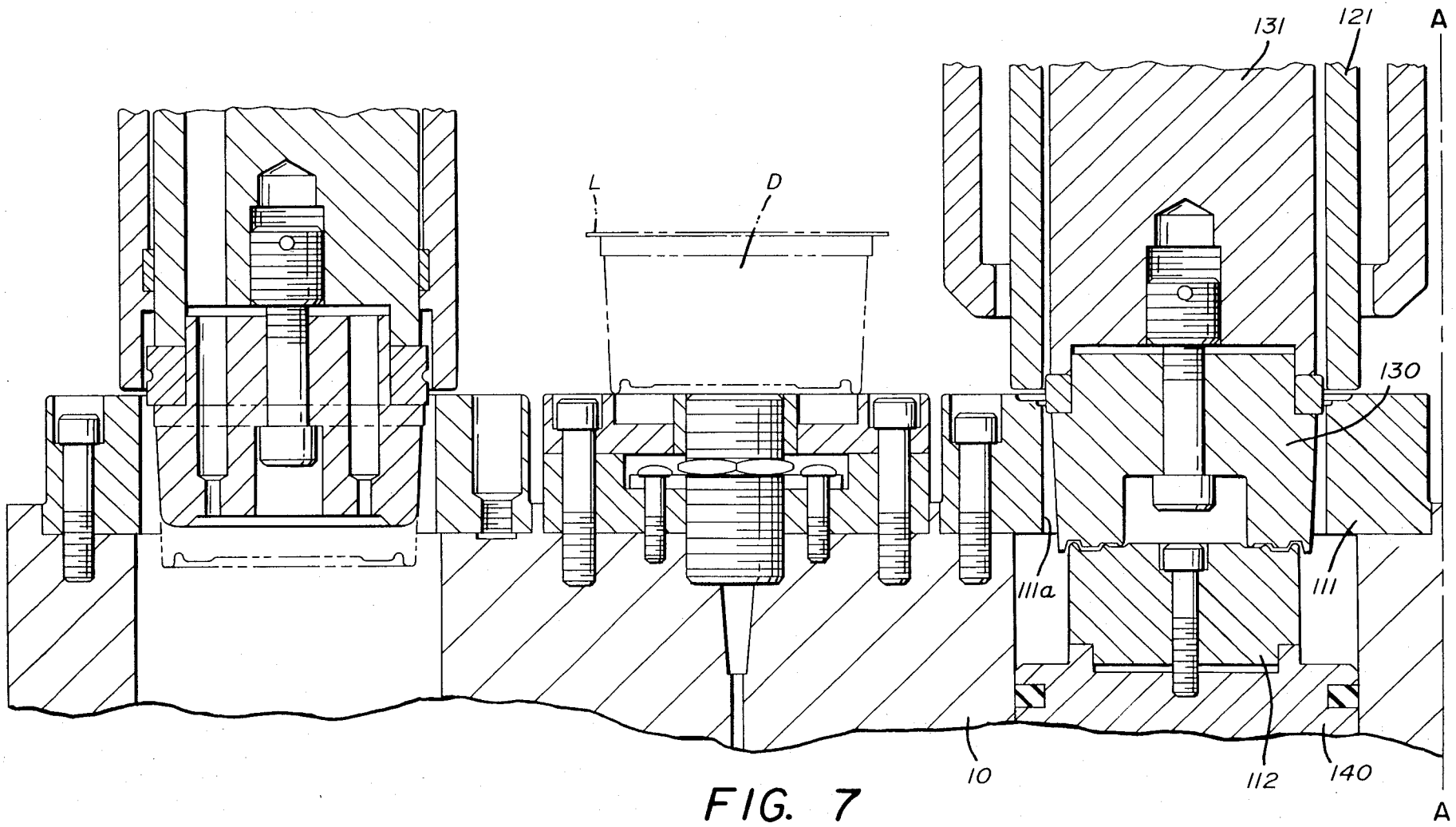

The material is then blanked and drawn into a cup as illustrated in FIG. 2 of the drawings by the letter B. Reference should also be had to FIGS. 6 and 7 of the drawings, wherein the progress of the container from the configuration of FIG. 2 to the configuration of FIG. 5 can be seen in stages viewed from the right of FIG. 6 to the left of FIG. 7.

The blanking and cupping operations are essentially conventional and well known to those of ordinary skill in this art and the apparatus for accomplishing them have, thus, not been illustrated.

Figure 3:
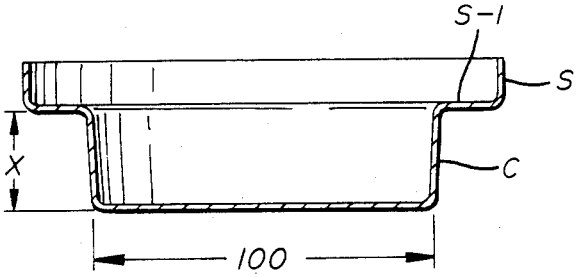
FIG. 3 is a sectional view showing the container after it has been drawn and trimmed to a partial depth.

FIG. 3 illustrates the container C after the first redraw, at which time the shoulder or top rim portion S has been formed, and the container has been redrawn, with a tapered wall, to about one-half of its final height.

Figure 4:
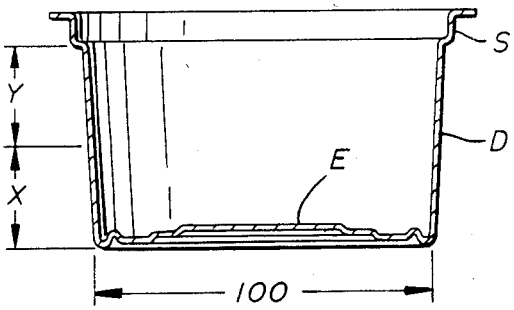
FIG. 4 is a sectional view showing the container after it has been drawn and profiled to its final depth.

FIG. 4 illustrates the container D after the second redraw and the profiling of its bottom E.

Figure 5:
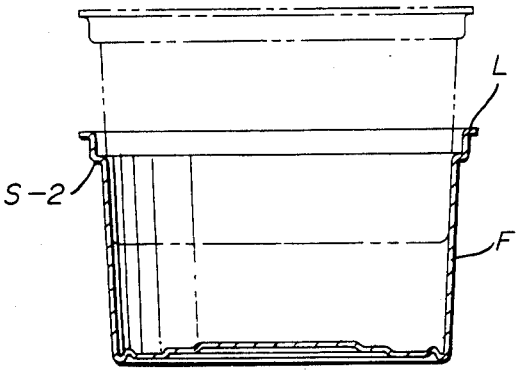
FIG. 5 is a sectional view showing the container after final trimming.

FIG. 5 illustrates container F in its finished condition after trimming of the top flange or lip L. This figure also shows a second container in nested relation to the first.

Since the blanking and cupping operation is essentially conventional, the detailed description of the invention will commence with the first redraw.

Accordingly, and referring to FIG. 6, the cup B is passed to a station for the second operation which is the first redraw operation. At this station, pressure sleeve 21 carried by the outer slide 22 of a double acting press of the type shown in Ridgway U.S. Pat. No. 3,902,347, moves down into holding contact with the bottom of the cup B. Sleeve 21 thus holds the cup against the top of die 11 which is mounted in bore 10*a* of bottom bolster 10 by screws 11*a*. Further downward movement of the inner slide of the press will bring the die center 30, which is tapered from top to bottom as shown, into contact with the bottom of the cup E, and further downward movement (see FIG. 6) of the inner slide carrying the die center 30 and the die riser 31, will draw the cup B around the radius 11*b* of the die 11, until the apparatus bottoms out on the bottoming pad 12 which is held on bottom bolster 10 by screw 12*a*.

Figure 6A:
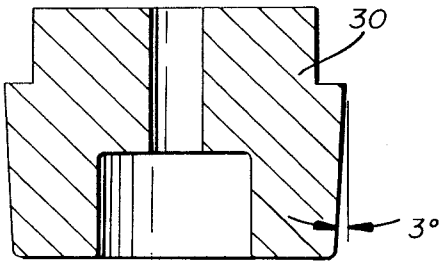
FIG. 6A is a partial elevational view of the die center for the first redraw.

It will be noted from FIG. 6A that the taper on die center 30 is indicated as being 3° relative to the vertical plane. While some variation is possible, this angle has been found to be the most desirable to impart the final nesting taper to the container while avoiding wrinkling during the forming operation.

At this point, the container will have the configuration illustrated in FIG. 3 by the letter C which is to say, the shoulder S will have been formed and the container will be about one-third its final height. Retraction of the inner and outer slides will retract the die center 30, die riser 31 out of the container C and the die 11, following which the container will be transferred by known mechanical means to a die checking station (see FIG. 6).

At this point, it should be noted that up to this point in the operation the container has essentially been drawn to one-half of its ultimate depth designated by the letter X in FIG. 3. It has been found that it is not possible in one operation to draw the container to its full depth because of the fact that wrinkles will tend to occur at the bottom. Due to the fact that a taper is being imparted to the sidewall, the clearance between the die center and the wall of the die will change progressively as the die center enters the die. If too deep a draw is attempted at once with such a taper, too much clearance would have to be provided and too much material would be left in the bottom of the container, thereby causing wrinkling. Of course, if the container walls were being drawn straight, the drawn can often could be done in one operation.

Here, however, imparting the taper is desired and it is necessary that the thickness be controlled throughout the ultimate depth of the container and the problem of draping or wrinkling must be avoided. Therefore, as noted, effectively, at this stage only the bottom half X of the container has been drawn and some of the original stock thickness has been left in the top half.

Thus, following the first redraw operation, and as already noted and still referring to FIGS. 1 through 7 of the drawings, the container C is transferred by known means from the first redraw station to a sensing station. It is then subsequently passed to a second redraw station (see FIG. 7).

Figure 8:
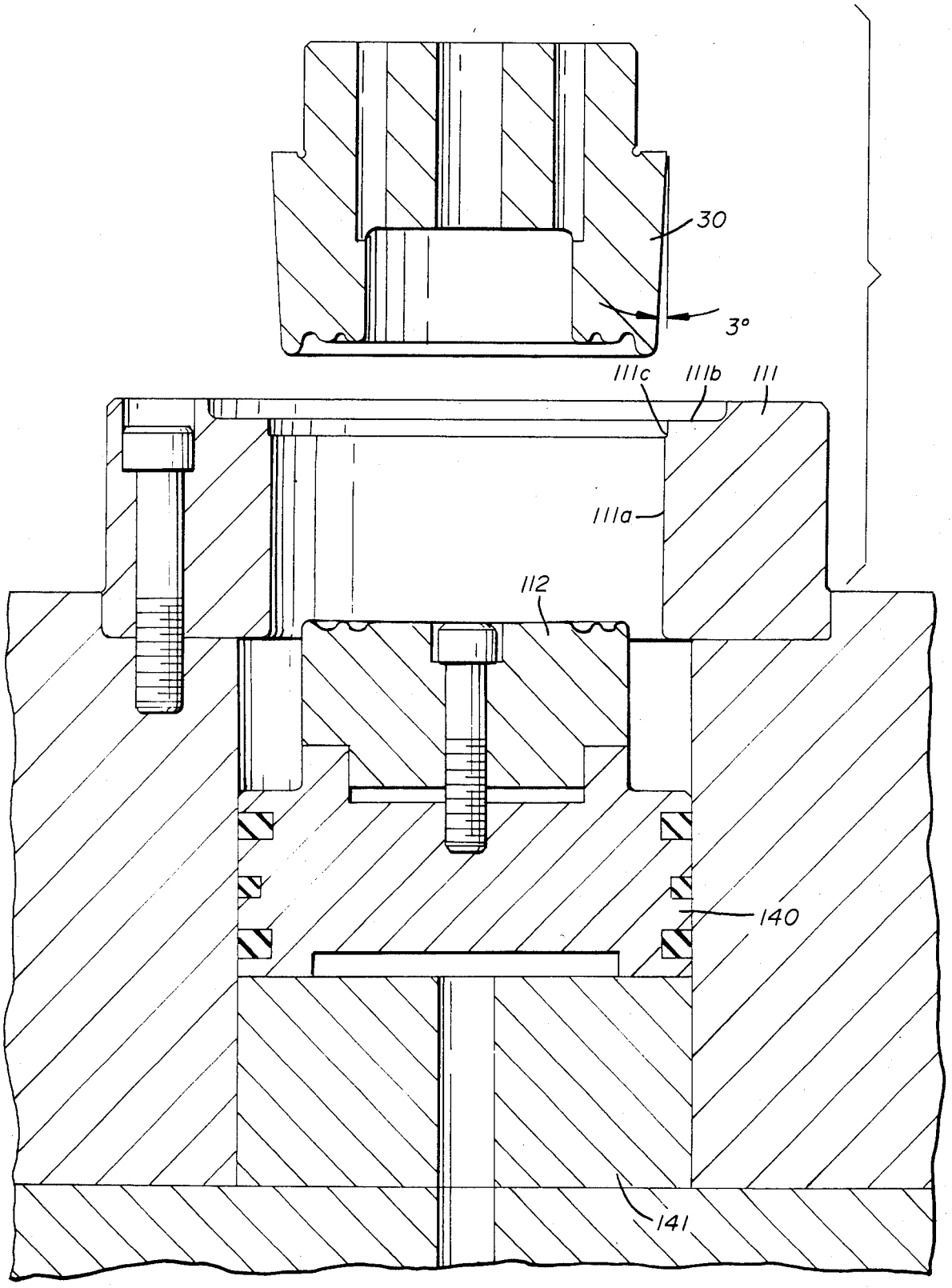
FIG. 8 is an enlarged view of the forming horn and die.

At this point, the final or second redraw operation is performed and reference is also made here to FIG. 8 of the drawings.

It will thus be seen that again a pressure sleeve 121, carried by the outer slide, is brought into contact with the horizontally extending surface S-1 of shoulder S of the container C to hold it against the top of die 111. It will be noted that when the pressure sleeve 121 reenters container C it engages the surface S-1 which is the same area engaged by sleeve 21 in the first draw. In other words, the metal is held at the same place for both draws. This eliminates what is known as the transition point and avoids undue thinning of the metal. Further downward movement of the slide will force the die riser 131 and die center 130 into the container C. It should also be noted here again that this die center 130 is also tapered (3° as shown), and that at this point the container is drawn to its full depth. In other words, in this operation the upper half Y of the container is effectively formed (see FIG. 4).

At this point, reference will be had to FIG. 8 of the drawings which is an enlarged view of the tooling required for the second redraw operation. It will be seen that die 111 has a central opening 111*a* for receipt of profile pad 112 which is secured to a cushion 140. The die 111 also has a first annular offset 111*b* and a second such offset 111*c* which will give the final configuration to shoulder or upper rim portion S.

Additionally, at this point it will be noted that the bottom E of the container is profiled by means of a profile pad 112 secured to a knockout pad or cushion 140 or bottoming pad 141. Actually what occurs at this station is that the profile pad 140 and knockout pad cushion 141 are under hydraulic or pneumatic pressure which serves to move them upward slightly toward die center 130 enabling the bottom profile E to be formed on the container C.

Retraction of the slide and its associated apparatus away from the die 111 will raise the container and the die center 130 above the die line following which the container C, can be transferred by known means to the next station, which is a sensing station.

Finally, the container D is transferred to the trim station, at which time the lip L is trimmed so that the final finished container assumes the shape illustrated in FIG. 5 of the drawings.

It should be noted that the diameter of the container remains unchanged from the first to the second redraw.

For example, in producing a 307×200 container, dimension 100 will be 3.063" in both FIGS. 3 and 4. However, the internal diameter of the die will change from a diameter of 3.170" in the first redraw (die 11) to 3.2665" in the second redraw (die 111).

In any event, once the lower diameter is set by the first redraw, it remains unchanged and no further operation is required.

In this way, essentially uniform sidewall thickness is achieved throughout the overall height dimension of the container, which is obviously advantageous for strength purposes. This uniform thickness is also obtained without wrinkling and thus avoids the need for any further operation to remove such wrinkles. This is particularly important since many of the contents of containers of this type are packed under pressure. That being the case, the thinnest wall area must be capable of withstanding the maximum pressure. Therefore, if there is any localized thinning during the drawing operation, this must be compensated for by increasing the initial stock thickness which is obviously wasteful and uneconomical.

Additionally, the taper which is imparted to the sidewall is such that it is possible to "nest" these containers for shipment (see FIG. 5), thereby eliminating the shipping problems previously referred to. However, the taper is also such that, in combination with the shoulder or top rim S, the containers will not stick to each other and are readily usable at the filling site.

It also should be noted that the annular external ridge S-2 where the shoulder S joins the sidewall, serves as an anvil once the container is completed, so that a conventional can opener can be utilized. This external ridge S-2 also serves to locate or orient the descriptive label, which is usually applied to the outer wall or periphery of the container. This also permits conventional seamers to be employed as contrasted to the normal situation wherein special hook seaming equipment is required.

While a full and complete description of the invention has been set forth in accordance with the dictates of the Patent Statutes, it should be understood that modifications can be resorted to without departing from the spirit hereof or the scope of the appended claims.

Thus, 3° has been mentioned herein as the preferred degree of taper. While that has been found to be the optimum angle to avoid wrinkling during the draws while permitting stacking after final forming, some variation therefrom is obviously within the scope of this invention.

What is claimed is:

1. A method of forming a wrinkle free tapered container from a thin metal blank in a double acting press having inner and outer rams, comprising the steps of:

(A) forming the blank into a cup with an integral bottom surface;

(B) holding the cup with tooling carried by the outer ram;

(C) partially forming said held cup with tooling carried by the inner ram by drawing it to a partial height while imparting a tapered configuration to the portion thus drawn; and (D) holding the cup with tooling carried by the outer ram;

(E) finally forming said held cup by drawing it to a final height with tooling carried by the inner ram and imparting a tapered configuration to the portion thus drawn.

2. The method of claim 1 wherein a pressure sleeve engages the same surface of the cup during Steps B, C, D, and E; said sleeve, in each step, engaging the cup in the same area.

3. The method of claim 1 wherein said cup is transferred from a first station to a second station after Step A and from said second station to a third station after Step C.

4. The method of claim 1 wherein said cup is drawn to approximately one-half its final height in Step C.

5. The method of claim 1 wherein the degree of taper achieved in Steps C and E is approximately three degrees (3°) from a vertical plane.

6. The method of claim 1 wherein said tapered configuration extends from the bottom of the drawn cup to a line spaced from the top edge thereof; the remaining sidewall being formed in a radially outwardly extending straight wall neck portion.

7. The method of claim 6 wherein the sidewall thickness of the drawn cup is substantially uniform from the neck portion to the bottom thereof.

8. The method of claim 1 wherein the bottom of the container is profiled during Step E.

9. Apparatus for imparting a tapered sidewall to a drawn container formed from a thin metal cup having a flange at its open end in a double acting press having inner and outer rams, comprising:

(A) a first redraw station including (1) a first die, (2) a first tapered redraw punch carried by the inner ram and movable toward and away from said die, and (3) pressure means carried by the outer ram for engaging the flange of the cup and holding the cup as said punch moves into drawing engagement therewith;

(B) said first tapered redraw punch being movable toward said first die sufficient distance to draw the cup to approximately one-half its final height;

(C) a second redraw station including (1) a second die, (2) a second tapered redraw punch carried by the inner ram and movable toward and away from said die, and (3) pressure means carried by the outer ram for engaging the flange of the cup and holding the container as said punch moves into drawing engagement therewith;

(D) said second tapered redraw punch being movable toward said second die sufficient distance to draw the cup to its final height and form a container.

10. The apparatus of claim 9 wherein said pressure means of said first and second redraw stations engage the same surface area of the cup.

11. The apparatus of claim 9 wherein said first and second punches are each tapered inwardly from adjacent their upper ends toward their bottom ends approximately three degrees (3°) from a vertical plane.

12. The apparatus of claim 11 wherein bottom profile means are carried by the apparatus at said second redraw station.

* * * * *